United States Patent [19]

Hanai et al.

[11] Patent Number: 5,009,575

[45] Date of Patent: Apr. 23, 1991

[54] VAPOR LOCK PREVENTING MECHANISM IN MOTOR-DRIVEN FUEL PUMP

[75] Inventors: Kazumichi Hanai; Koichi Mine; Hikaru Kikuta, all of Obu, Japan

[73] Assignee: Aisan Kogyo Kabushiki Kaisha, Obu, Japan

[21] Appl. No.: 428,886

[22] Filed: Oct. 31, 1989

[30] Foreign Application Priority Data

Nov. 7, 1988 [JP] Japan ..... 63-145311[U]

[51] Int. Cl.[5] ..... F04D 9/00

[52] U.S. Cl. ..... 417/244; 415/55.1; 415/55.5

[58] Field of Search ..... 415/55.1, 55.5, 55.6; 417/244

[56] References Cited

FOREIGN PATENT DOCUMENTS 62-214294 9/1987 Japan .
63-100686 6/1988 Japan .
2134598 8/1984 United Kingdom ..... 415/55.6

*Primary Examiner*—Gerald A. Michalsky
*Attorney, Agent, or Firm*—Dennison, Meserole, Pollack & Scheiner

[57] ABSTRACT

A multi-stage motor-driven fuel pump including a motor section provided with an electric motor and a pump section to be driven by the electric motor, the pump section having a plurality of pump chambers partitioned by intermediate plates and communicated with each other by a fuel communication hole formed through each of the intermediate plates. A ratio of a sectional area of the fuel communication hole of any one of the intermediate plates between adjacent ones of the pump chambers to a sectional area of the pump chamber on a lower pressure side is set in a predetermined range such that a gradient of fuel pressure increase in the pump section is increased to early prevent vapor lock.

8 Claims, 7 Drawing Sheets

VAPOR LOCK PREVENTING MECHANISM IN MOTOR-DRIVEN FUEL PUMP

BACKGROUND OF THE INVENTION

The present invention relates to a vapor lock preventing mechanism in a motor-driven fuel pump.

Conventionally, there is disclosed in Japanese Patent Laid-open Publication No. 62-214294 a motor-driven fuel pump provided with a vapor jet in a pump chamber for eliminating a fuel vapor generated in the pump chamber at high temperatures or drawn with a fuel upon sucking of the fuel into the pump chamber and thereby preventing vapor lock.

Such a vapor jet is normally provided at a high-pressure position in the pump chamber. In the case of a multi-stage motor-driven pump, the vapor jet is provided at a high-pressure position in a first-stage pump chamber on a suction side of the pump section, so as to efficiently eliminate the fuel vapor under the high fuel pressure. However, if a large amount of fuel vapor is generated in the case of using a light gasoline as the fuel, for example, the fuel vapor resides widely in the pump chamber to pass the position of the vapor jet or generate vapor lock in the worst case.

Such a problem is considered to be eliminated by enlarging a diameter of the vapor jet or forming the vapor jet at a higher-pressure position to thereby improve a vapor discharging ability. However, the fuel is largely leaked with the fuel vapor through the vapor jet to cause a reduction in fuel discharge quantity of the pump and a reduction in pump ability at an ordinary temperature.

In another type two-stage motor-driven fuel pump disclosed in Japanese Utility Model Publication No. 63-100686, a first impeller has a thickness and a vane depth greater than a second impeller to thereby increase a gradient of fuel pressure increase in a first pump chamber, thereby early diminishing the fuel vapor generated in the first pump chamber or efficiently eliminating the fuel vapor from the vapor jet.

However, in the latter case, since the first impeller and the second impeller have different shapes and sizes as mentioned above, a common member for each pump stage cannot be utilized, and an overall size of the pump section is increased.

SUMMARY OF THE INVENTION

It is an object of the present invention to provide a multi-stage motor-driven pump which may efficiently prevent vapor lock with use of a common member for each pump stage.

According to one aspect of the present invention, there is provided a multi-stage motor-driven fuel pump comprising a motor section provided with an electric motor and a pump section to be driven by said electric motor, said pump section having a plurality of pump chambers partitioned by intermediate plates and communicated with each other by a fuel communication hole formed through each of said intermediate plates; wherein a ratio of a sectional area of said fuel communication hole of any one of said intermediate plates between adjacent ones of said pump chambers to a sectional area of said pump chamber on a lower pressure side is set in a predetermined range such that a gradient of fuel pressure increase in said pump section is increased to early prevent vapor lock.

With this construction, as the ratio of the sectional area of the fuel communication hole formed through the intermediate plate between the adjacent pump chambers to the sectional area of the pump chamber on a lower pressure side is set in the predetermined range, the gradient of fuel pressure increase in the pump section is increased to thereby efficiently diminish fuel vapor generated in the pump chambers and early prevent vapor lock.

According to a second aspect of the present invention, there is provided a multi-stage motor-driven fuel pump comprising a motor section provided with an electric motor and a pump section to be driven by said electric motor, said pump section having a plurality of pump chambers, a fuel inlet communicated with a first one of said pump chambers, and a fuel outlet communicated with a final one of said pump chambers; wherein a ratio of a sectional area of said fuel outlet to a sectional area of a final one of said pump chambers is set in a predetermined range such that a gradient of fuel pressure increase in said pump section is increased to early prevent vapor lock.

With this construction, as the ratio of the sectional area of the fuel outlet of the pump section to the sectional area of the final pump chamber is set in the predetermined range, the gradient of fuel pressure increase in the pump section is increased to thereby early reach a predetermined fuel pressure and efficiently diminish fuel vapor generated in the pump chambers, thereby early preventing vapor lock.

In summary, the fuel pressure in the pump section can be increased early by suitably setting the sectional area of the fuel outlet of any one of the pump chambers. Thus, it is only necessary to simply work the fuel outlet, and a common member can be used for each pump stage. Accordingly, a manufacturing cost can be reduced, and an overall size of the motor-driven pump can be maintained compact.

Especially, in the case that the above-mentioned predetermined range is set to 0.5–1.4, and that a normal gasoline is used as the fuel, the generation of vortex due to separation of fuel stream and cavitation can be prevented to effect desirable vapor lock prevention with desired amount of fuel flow and fuel pressure maintained.

The invention will be more fully understood from the following detailed description and appended claims when taken with the drawings.

DETAILED DESCRIPTION OF THE PREFERRED EMBODIMENTS

There will now be described a first preferred embodiment of the present invention with reference to FIGS. 1 to 8.

Figure 1:
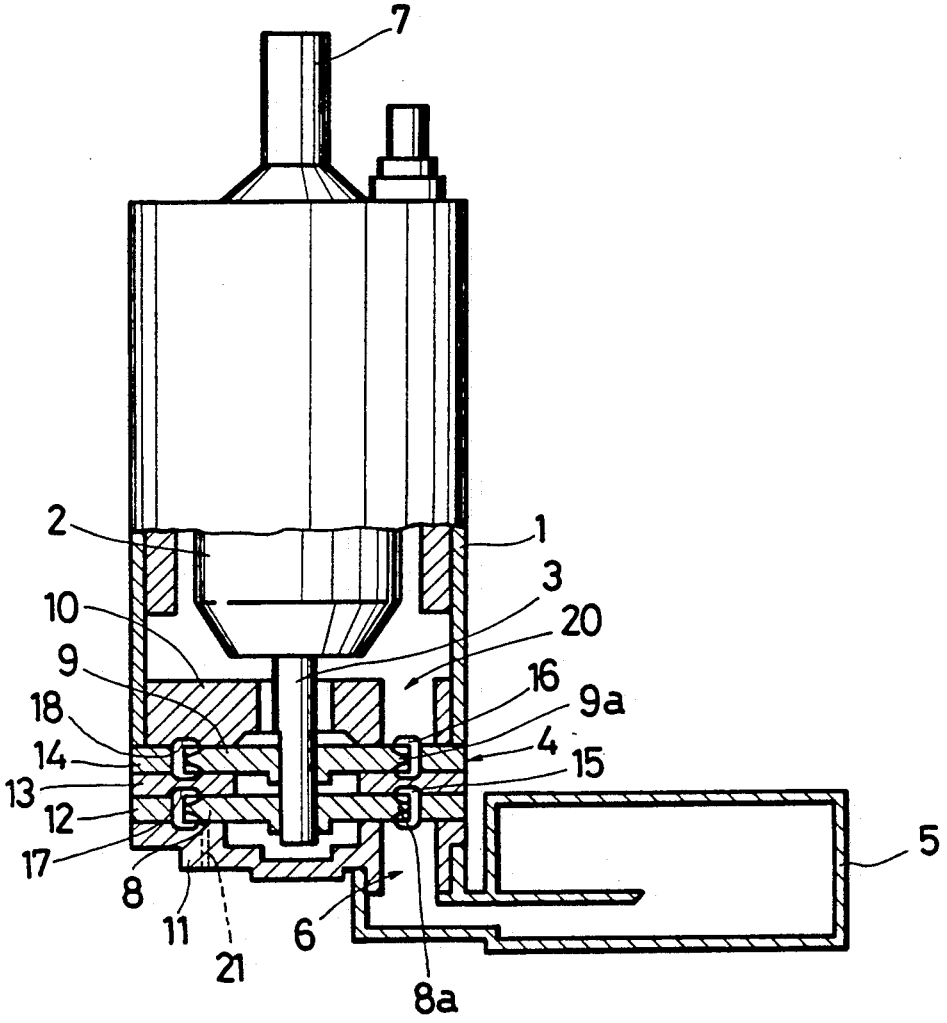
FIG. 1 is a partially cutaway elevational view of a first preferred embodiment of the motor-driven pump according to the present invention.

Referring to FIG. 1 which is a partially cutaway elevational view of the motor-driven fuel pump of a so-called in-tank type such that the fuel pump is so mounted as to be submerged in a fuel tank (not shown) for storing a fuel. The fuel pump is generally constructed of a cylindrical casing 1, a motor section disposed in the casing 1 and including an electric motor 2 having a motor shaft 3, and a pump section 4 of a cascade type disposed below the casing 1 and operatively connected to the motor section so as to be driven by the motor shaft 3. A filter 5 is connected to a fuel inlet 6 of the pump section 4, so that the fuel is sucked by the pump section 4 to be fed through the filter 5 through the pump section 4 into the casing 1. Then, the fuel is fed through an annular space around the electric motor 2 and through a check valve (not shown) to a fuel outlet 7 formed at an upper end of the casing 1. Then, the fuel is discharged from the fuel outlet 7.

The pump section 4 is constructed of a pair of first impeller 8 and second impeller 9 having the same shape and size which are centrally fixed to the motor shaft 3 of the electric motor 2, an outlet body 10 fixed by bonding to a lower end of the casing 1, an inlet body 11 fixed by screws (not shown) to the outlet body 10, a first annular spacer 12, an intermediate annular plate 13 and a second annular spacer 14 which spacers and plate are fixedly interposed between the outlet body 10 and the inlet body 11. Under the assembled condition of these elements of the pump section 4, a first pump chamber 15 is defined among the inlet body 11, the first spacer 12, the intermediate plate 13 and the first impeller 8, while a second pump chamber 16 is defined among the intermediate plate 13, the second spacer 14, the outlet body 10 and the second impeller 9. Thus, the pump section 4 is constructed as a two-stage pump. That is, a first fuel flow groove 17 is formed on the upper surface of the inlet body 10 and on the lower surface of the intermediate plate 13 along an outer circumferential vane 8*a* of the first impeller 8, and an annular space is defined between the outer circumferential vane 8*a* of the first impeller 8 and the inner circumference of the first spacer 12, thus forming the first pump chamber 15. Similarly, a second fuel flow groove 18 is formed on the upper surface of the intermediate plate 13 and the lower surface of the outlet body 10 along an outer circumferential vane 9*a* of the second impeller 9, and an annular space is defined between the outer circumferential vane 9*a* of the second impeller 9 and the inner circumference of the second spacer 14, thus forming the second pump chamber 16.

The fuel inlet 6 is formed through the inlet body 11 to communicate with the first pump chamber 15, and a first outlet 19 (see FIGS. 2 and 3) is formed through the intermediate plate 13 to communicate with the first pump chamber 15 and the second pump chamber 16. Further, a second outlet 20 is formed through the outlet body 10 to communicate with the second pump chamber 16 and the motor section. Thus, the fuel is sucked from the fuel inlet 6 into the first pump chamber 15, and a pressure of the fuel is gradually increased by the rotation of the first impeller 8. Then, the fuel is discharged from the first outlet 19, and is fed into the second pump chamber 16, wherein a pressure of the fuel is further increased by the rotation of the second impeller 9. Thereafter, the fuel having a high pressure is discharged from the second outlet 20 to the motor section.

Figure 6:
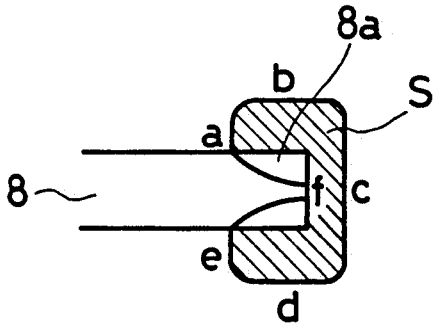
FIG. 6 is a view similar to FIG. 5, showing a sectional area of a first pump chamber shown in FIG. 4.

The vapor lock preventing means in the first preferred embodiment is constructed in such a manner that a sectional area of the first outlet 19 formed through the intermediate plate 13 is substantially equal to a sectional area S of the first pump chamber 15 (which sectional area S is represented by a hatched portion surrounded by a-b-c-d-e-f-a shown in FIG. 6).

Figure 4:
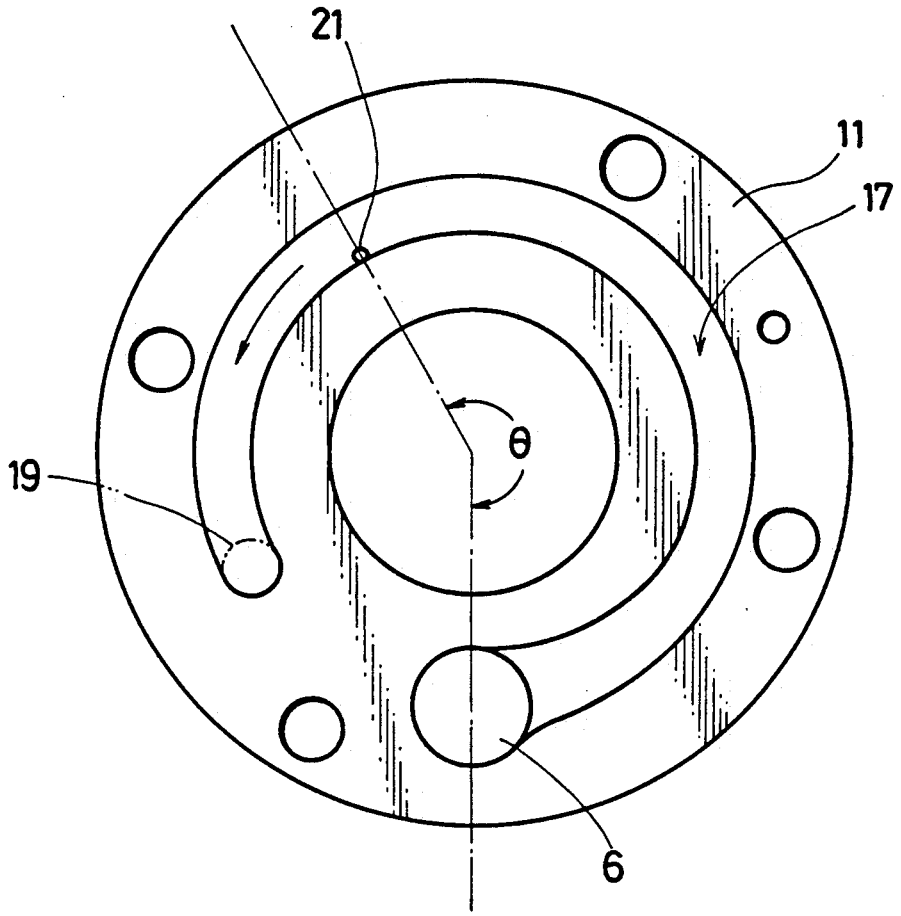
FIG. 4 is a plan view of an inlet body shown in FIG. 1.
Figure 5:
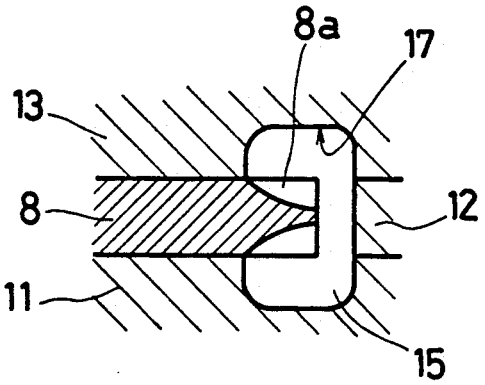
FIG. 5 is an enlarged sectional view of a part of a first pump stage shown in FIG. 1.

Further, as shown in FIG. 4, the inlet body 11 is formed with a vapor jet 21 having a small diameter, which communicates the fuel flow groove 17 with the outside of the fuel pump. The vapor jet 21 is located at an angular position $\theta$ as measured from the position of the fuel inlet 6 in a direction of fuel flow as shown by an arrow.

On the other hand, a sectional area of the fuel inlet 6 is larger than the sectional area S of the first pump chamber 15 in the same manner as the prior art (a ratio of the former to the latter is set to about 5). Further, a sectional area of the second outlet 20 is larger than a sectional area of the second pump chamber 16 (which sectional area is equal to the sectional area S of the first pump chamber 15) in the same manner as the prior art (a ratio of the former to the latter is also set to about 5).

Figure 17:
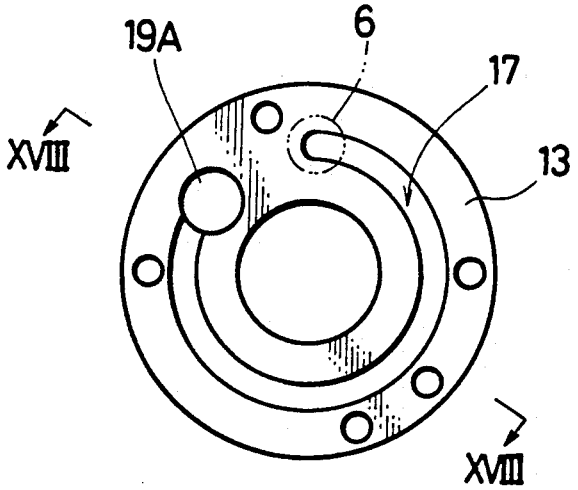
FIG.17 PRIOR ART
FIG. 17 is a view similar to FIG. 2, showing the prior art.
Figure 18:
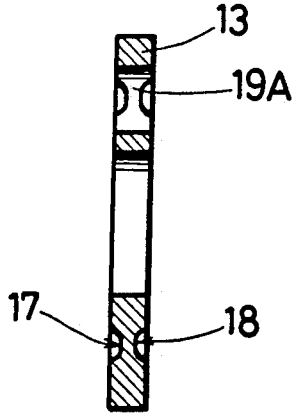
FIG.18 PRIOR ART
FIG. 18 is a cross section taken along the line XVIII—XVIII in FIG. 17.
Figure 2:
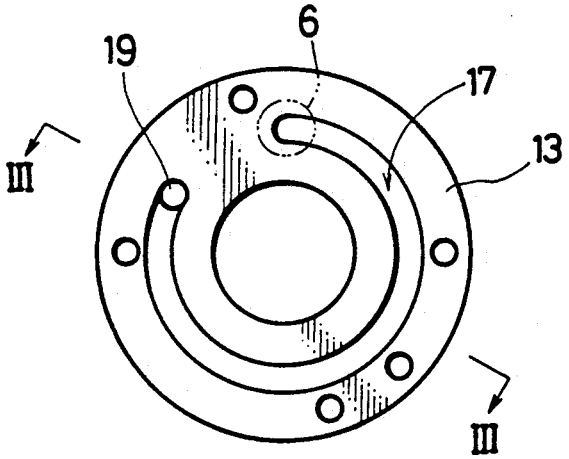
FIG. 2 is a bottom plan view of an intermediate plate shown in FIG. 1.
Figure 3:
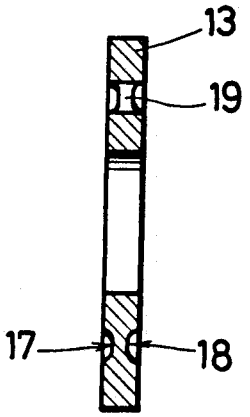
FIG. 3 is a cross section taken along the line III—III in FIG. 2.
Figure 7:
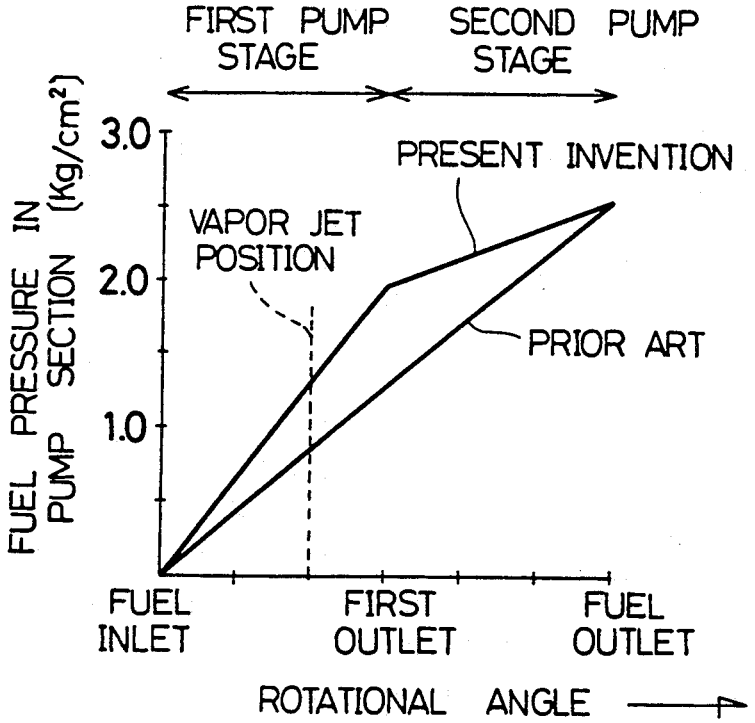
FIG. 7 is a characteristic graph of a fuel pressure in the pump section with respect to a rotational angle of the pump section, according to the first preferred embodiment and the prior art.

FIGS. 17 and 18 show the prior art construction of the intermediate plate 13, wherein a first outlet 19A is different in sectional area from the first outlet 19 shown in FIGS. 2 and 3, and the other parts are identical with each other. That is, as apparent from FIGS. 17 and 18 in comparison with FIGS. 2 and 3, the sectional area of the first outlet 19A in the prior art is larger than that of the first outlet 19 of the first preferred embodiment of the present invention. Specifically, the sectional area of the first outlet 19A is set in such a manner that a fuel pressure at the first outlet 19A is substantially half a fuel pressure at the second outlet 20, and it is increased substantially linearly until the fuel is discharged from the second outlet 20 as shown in FIG. 7.

To the contrary, the sectional area of the first outlet 19 in the first preferred embodiment is substantially the same as that of the sectional area of the first pump chamber 15. In other words, the sectional area of the first outlet 19 is smaller than that of the first outlet 19A in the prior art. Accordingly, as shown in FIG. 7, a gradient of fuel pressure increase in the first pump chamber 15 from the fuel inlet 6 to the first outlet 19 is greater than that in the prior art. In the second pump chamber 16, the gradient of fuel pressure increase is reduced to reach a predetermined pressure at the second outlet 20 to be adjusted by a pressure regulator (not shown) provided in a fuel pipe leading from the fuel outlet 7 to a fuel injector (not shown).

As mentioned above, the gradient of fuel pressure increase in the first pump chamber 15 is made higher than that in the prior art by reducing the sectional area of the first outlet 19 to be substantially equal to the sectional area of the first pump chamber 15. Accordingly, fuel vapor generated in the first pump chamber 15 can be early deminished by the high fuel pressure even when a light fuel is used. Further, as the vapor jet 21 for eliminating the fuel vapor is provided at a high-pressure position in the first pump chamber 15 to be communicated with the atmosphere, the fuel vapor can be effectively eliminated from the vapor jet 21. For example, the high-pressure position where the vapor jet 21 is formed is shown by a dotted line in FIG. 7. Accordingly, as apparent from FIG. 7, the fuel pressure at the vapor jet 21 can be higher than that in the prior art to thereby efficiently eliminate the fuel vapor from the vapor jet 21.

Thus, in the first preferred embodiment, the sectional area of the first outlet 19 of the first pump chamber 15 is reduced to thereby make the gradient of fuel pressure increase greater than that in the prior art, with the result that the fuel pressure at the first outlet 19 is made greater than that in the prior art to suppress the generation of the fuel vapor and prevent the vapor lock in the first pump chamber 15.

Figure 8:
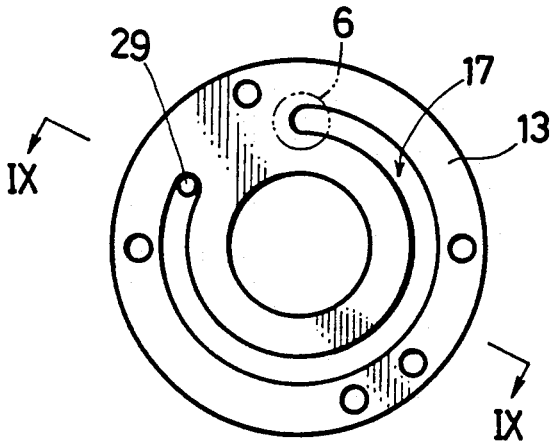
FIG. 8 is a view similar to FIG. 2, showing a modification of the first preferred embodiment.
Figure 9:
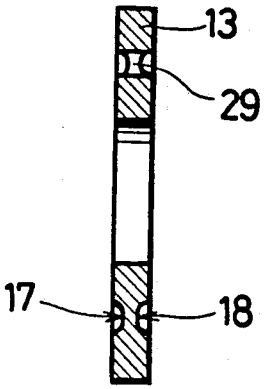
FIG. 9 is a cross section taken along the line IX—IX in FIG. 8.

FIGS. 8 and 9 show a modification of the first preferred embodiment shown in FIGS. 2 and 3, wherein a ratio of the sectional area of a first outlet 29 to the sectional area S of the first pump chamber 15 is set to about 0.5.

The selection of the first outlet 19 of the first preferred embodiment or the first outlet 29 of this modification is dependent upon a kind of fuel to be used. Further, a degree of reduction in sectional area of the first outlet is also dependent upon a kind of fuel to be used. That is, the lighter the fuel, the smaller the sectional area of the first outlet is made to more increase the gradient of fuel pressure increase. Especially in the case of using a normal gasoline as the fuel, the ratio of the sectional area of the first outlet 19 to the sectional area S of the first pump chamber is preferably set to a range of 0.5–1.4 for the following reasons.

Figure 10:
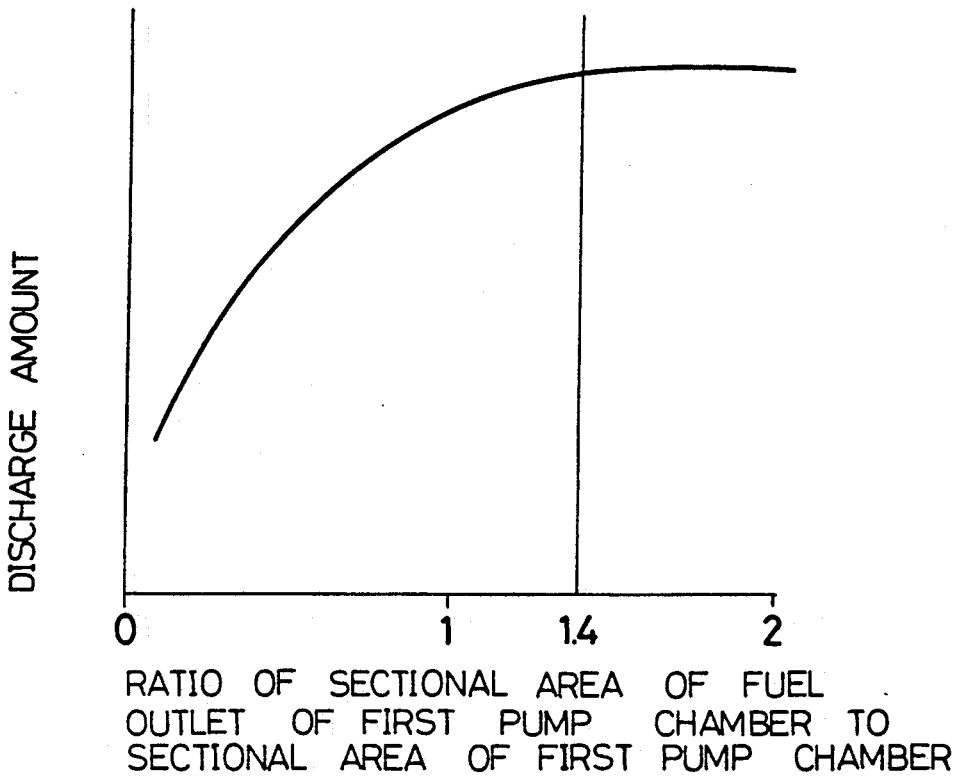
FIG. 10 is a characteristic graph of a pump discharge amount with respect to a ratio of a sectional area of a fuel outlet of a first pump chamber to a sectional area of the first pump chamber in the case of using gasoline as the fuel.
Figure 11:
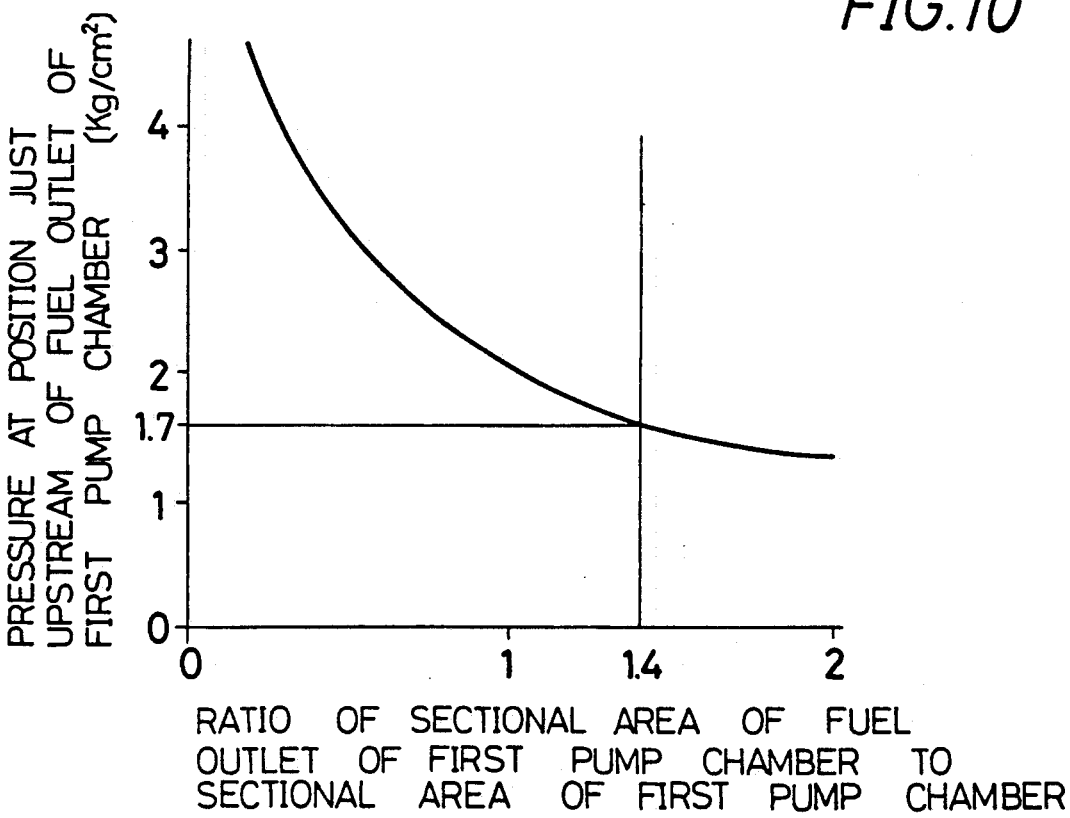
FIG. 11 is a characteristic graph of a pressure at a position just upstream of the fuel outlet of the first pump chamber with respect to the ratio of the sectional area of the fuel outlet of the first pump chamber to the sectional area of the first pump chamber in the case of using gasoline as the fuel.
Figure 12:
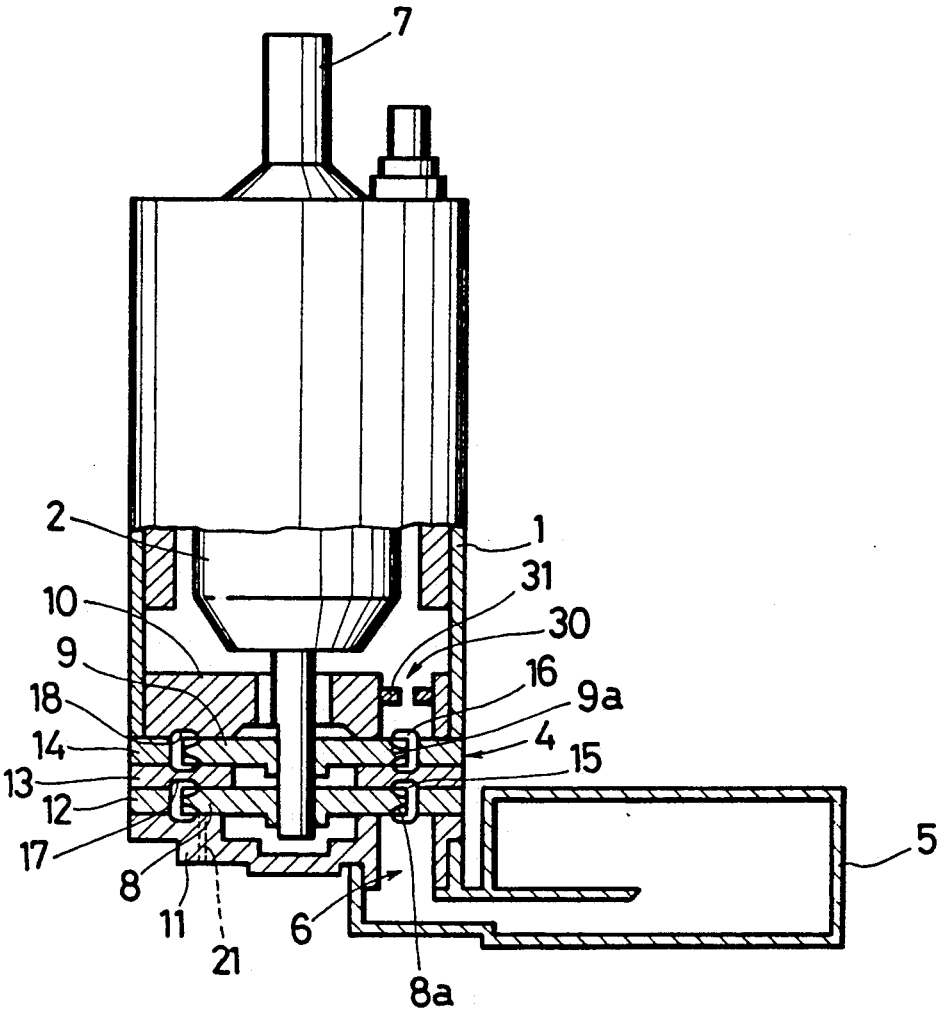
FIG. 12 is a view similar to FIG. 1, showing a second preferred embodiment of the present invention.
Figure 13:
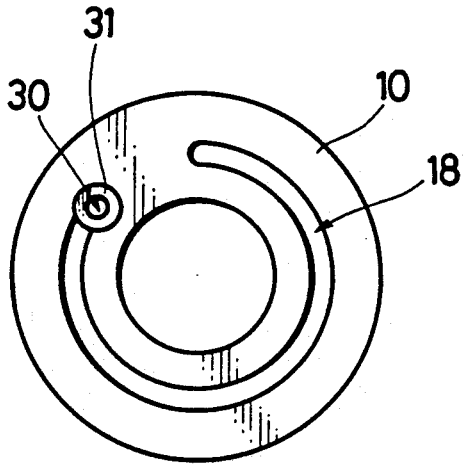
FIG. 13 is a bottom plan view of an outlet body shown in FIG. 12.
Figure 14:
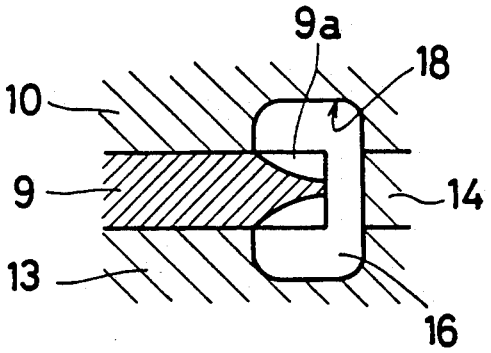
FIG. 14 is an enlarged sectional view of a part of a second pump stage shown in FIG. 12.

FIG. 10 shows the relationship between the ratio of the sectional area of the first outlet 19 to the sectional area S of the first pump chamber and the discharge amount of the fuel pump, and FIG. 11 shows the relationship between the above-mentioned ratio and the pressure at a position just upstream of the first outlet 19. In the graphs of FIGS. 10 and 11, a pump discharge pressure is controlled to 2.55 kg/cm$^2$, and a normal gasoline (leadless regular gasoline; Reid vapor pressure: 0.75 kg/cm$^2$ at 37.8° C.) was used in the test. It has been realized in the test that the vapor lock prevention is remarkably effective when the pressure at the position just upstream of the first outlet 19 is 1.7 kg/cm$^2$ or more at a fuel temperature of 25° C. (or 1.3 kg/cm$^2$ or more at a fuel temperature of 40° C.). The specification of the fuel pump used in the test is as follows:

Diameter of the first impeller 8=Diameter of the second impeller 9=35 mm Sectional area S of the first pump chamber 15=Sectional area S of the second pump chamber 16=9.24 mm$^2$ Inner diameter of the vapor jet 21=0.9 mm Angular position $\theta$ of the vapor jet 21=210°

(Angle from the fuel inlet 6 to the first outlet 19=300°)

As apparent from FIG. 10, the pump discharge amount becomes almost constant near the ratio of 1.4. Further, as apparent from FIG. 11, when the ratio exceeds 1.4, the pressure at the position just upstream of the first outlet 19 becomes less than 1.7 kg/cm$^2$. Accordingly, the ratio must be set to equal to or less than 1.4. If the ratio is set to be greater than 1.4, there will be generated separation of fuel stream at the fuel outlet to cause a turbulent flow and the generation of fuel vapor.

On the other hand, if the ratio is set to be less than 0.5, a difference between a flow rate of the fuel in the fuel flow groove 17 and a velocity of the vanes of the first impeller 8 becomes large to cause the generation of cavitation. Further, the flow rate at the first outlet 19 is increased by the suction from the second pump chamber 16 to cause a reduction in pressure at the postion just upstream of the first outlet 19. Consequently, it is necessary to set the ratio to the range of 0.5–1.4.

Although the predetermined range of 0.5–1.4 is applied to the case that the diameter of the first impeller 8 and the second impeller 9 is set to 35 mm in the above preferred embodiment, the same range of the ratio may be applied to the cases where the diameter ranges from 25 mm to 50 mm, which cases may exhibit the similar vapor lock prevention effect. Such a range of the diameter is desirable in respect of a pump size suitable for mounting into an automotive fuel tank.

Figure 15:
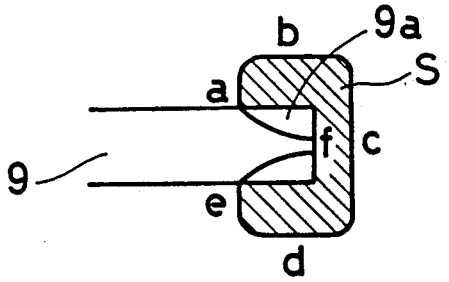
FIG. 15 is a view similar to FIG. 14, showing a sectional area of a second pump chamber shown in FIG. 14.

Referring next to FIGS. 12 to 16 which show a second preferred embodiment of the present invention, wherein the same reference numerals as in the first preferred embodiment denote the same parts, an orifice 31 is provided in a second outlet 30, and an opening area of the orifice 31 is set to be substantially equal to the sectional area S of the second pump chamber 16 as shown by a hatched portion surrounded by a-b-c-d-e-f-a in FIG. 15. Accordingly, the sectional area of the second outlet 30 is restricted by the opening area of the orifice 31. On the other hand, the sectional area of the first outlet (not shown in FIGS. 12 to 16) is the same as that of the first outlet 19A in the prior art.

Figure 16:
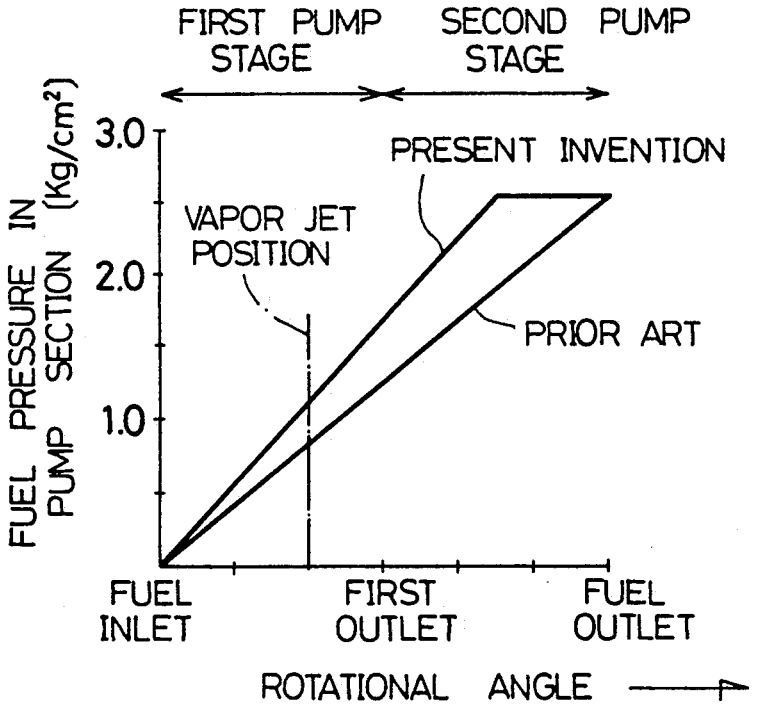
FIG. 16 is a view similar to FIG. 7, according to the second preferred embodiment and the prior art.

Accordingly, the fuel pressure is increased substantially linearly from the fuel inlet 6 to the second outlet 30 in the same manner as the prior art. However, as the sectional area of the second outlet 30 is restricted by the restriction 31, a gradient of fuel pressure increase can be made greater than that in the prior art as shown in FIG. 16, and a predetermined fuel pressure to be adjusted by the pressure regulator can be reached earlier than the prior art. As apparent from FIG. 16, the fuel pressure in the first pump chamber 15 can be made greater than that in the prior art. Accordingly, the fuel vapor generated in the first pump chamber 15 can be diminished earlier than the prior art, and the fuel vapor can be more efficiently eliminated from the vapor jet 21 owing to the high fuel pressure.

The opening area of the orifice 31 is dependent upon a kind of fuel to be used. That is, the lighter the fuel, the smaller the opening area of the orifice 31 is made.

Further, although the above-mentioned preferred embodiments are applied to a two-stage motor-driven fuel pump, the present invention may be applied to a multi-stage motor-driven fuel pump having three or more pump chambers.

Having thus described the preferred embodiments of the invention, it should be understood that numerous structural modifications and adaptations may be made without departing from the spirit of the invention.

What is claimed is:

1. A two-stage fuel pump comprising:

(a) a first impeller;

(b) a first wall for surrounding said first impeller;

(b-1) a first pump chamber being defined between an inner surface of said first wall and an outer circumference of said first impeller;

(b-2) said first wall being formed with a fuel inlet communicating with said first pump chamber to suck fuel into said first pump chamber;

(b-3) said first wall being formed with a vapor jet communicating with said first pump chamber to discharge a vapor of said fuel from said first pump chamber;

(c) a second impeller having a size and a shape identical with those of said first impeller; and (d) a second wall for surrounding said second impeller;

(d-1) a second pump chamber being defined between an inner surface of said second wall and an outer circumference of said second impeller;

(d-2) said second pump chamber having a sectional shape substantially the same as that of said first pump chamber;

(d-3) said second wall being formed with a fuel outlet communicating with said second pump chamber to discharge said fuel;

(d-4) a part of said second wall partitioning said first pump chamber from said second pump chamber, said part being formed with a communication hole for communicating said first pump chamber with said second pump chamber;

(e) wherein a ratio of (a sectional area of said communication hole)/(a sectional area of said first pump chamber) is less than a ratio of (a sectional area of said fuel outlet)/(a sectional area of said second pump chamber);

(f) whereby a boosting rate in said first pump chamber can be made larger than that in said second pump chamber to efficiently discharge said vapor.

2. The two-stage fuel pump as defined in claim 1, wherein the ratio of (the sectional area of said communication hole)/(the sectional area of said first pump chamber) is equal to or less than 1.4.

3. The two-stage fuel pump as defined in claim 2, wherein the ratio of (the sectional area of said communication hole)/(the sectional area of said first pump chamber) is equal to or greater than 0.5.

4. The two-stage fuel pump as defined in claim 3, wherein said first and second impellers have a diameter of 25 to 50 mm.

5. The two-stage fuel pump as defined in claim 1, wherein said vapor jet is formed at a position where a fuel pressure is boosted to a value greater than a half of a set pressure of a pressure regulator for regulating a pressure of said fuel to be discharged from said fuel outlet.

6. A two-stage fuel pump comprising:

(a) a first impeller;

(b) a first wall for surrounding said first impeller;

(b-1) a first pump chamber being defined between an inner surface of said first wall and an outer circumference of said first impeller;

(b-2) said first wall being formed with a fuel inlet communicating with said first pump chamber to suck fuel into said first pump chamber;

(b-3) said first wall being formed with a vapor jet communicating with said first pump chamber to discharge a vapor of said fuel from said first pump chamber;

(c) a second impeller having a size and a shape identical with those of said first impeller; and (d) a second wall for surrounding said second impeller;

(d-1) a second pump chamber being defined between an inner surface of said second wall and an outer circumference of said second impeller;

(d-2) said second pump chamber having a sectional shape substantially the same as that of said first pump chamber;

(d-3) said second wall being formed with a fuel outlet communicating with said second pump chamber to discharge said fuel;

(d-4) a part of said second wall partitioning said first pump chamber from said second pump chamber, said part being formed with a communication hole for communicating said first pump chamber with said second pump chamber;

(e) wherein a ratio of (a sectional area of said fuel outlet)/(a sectional area of said second pump chamber) is equal to or less than 1.4, and said vapor jet is formed at a position where a fuel pressure is boosted to a value greater than a half of a set pressure of a pressure regulator for regulating a pressure of said fuel to be discharged from said fuel outlet;

(f) whereby a boosting rate in said first pump chamber can be made larger than that in said second pump chamber to efficiently discharge said vapor.

7. The two-stage fuel pump as defined in claim 6, wherein the ratio of (the sectional area of said fuel outlet)/(the sectional area of said second pump chamber) is equal to or greater than 0.5.

8. The two-stage fuel pump as defined in claim 7, wherein said first and second impellers have a diameter of 25 to 50 mm.

* * * * *